US006537139B2

(12) United States Patent
Ohmori

(10) Patent No.: US 6,537,139 B2
(45) Date of Patent: Mar. 25, 2003

(54) APPARATUS AND METHOD FOR ELID GRINDING A LARGE-DIAMETER WORKPIECE TO PRODUCE A MIRROR SURFACE FINISH

(75) Inventor: Hitoshi Ohmori, Wako (JP)

(73) Assignee: Riken (JP)

( * ) Notice: Subject to any disclaimer, the term of this patent is extended or adjusted under 35 U.S.C. 154(b) by 0 days.

(21) Appl. No.: 09/880,011

(22) Filed: Jun. 14, 2001

(65) Prior Publication Data

US 2001/0053661 A1 Dec. 20, 2001

(30) Foreign Application Priority Data

Jun. 16, 2000 (JP) ..... 2000-181281

(51) Int. Cl.[7] ..... B24B 53/00
(52) U.S. Cl. ..... 451/56; 451/72; 125/11.01
(58) Field of Search ..... 451/56, 72, 41, 451/443, 908; 125/11.01, 11.22

(56) References Cited

U.S. PATENT DOCUMENTS 5,547,414 A * 8/1996 Ohmori ..... 451/21
6,196,901 B1 * 3/2001 Minami ..... 451/63

FOREIGN PATENT DOCUMENTS

| | | | | |
|---|---|---|---|---|
| JP | 40-4082662 | * | 3/1992 | ..... 451/72 |
| JP | 40-4159039 | * | 6/1992 | ..... 451/56 |
| JP | 40-4164570 | * | 6/1992 | ..... 125/11.01 |

* cited by examiner

*Primary Examiner*—Robert A. Rose
(74) *Attorney, Agent, or Firm*—Griffin & Szipl, P.C.

(57) ABSTRACT

A flat workpiece 5 (silicon wafer) is driven so as to rotate in horizontal by a workpiece driving device 12. A cylindrical conducting grindstone 14 is provided, the outer periphery of which is in contact with the surface of the workpiece. A grindstone rotating device 16 drives the grindstone about the axis thereof. A grindstone reciprocating device 18 moves the grindstone with a reciprocating motion along the surface of the workpiece. An axial guiding device 20 keeps the center line X of the grindstone at a predetermined angle to the horizontal axis. An ELID device 22 electrolytically dresses the outer periphery of the grindstone. The center line X of the grindstone is held at a predetermined angle θ to the horizontal axis, and at the same time, the outer periphery of the grindstone is dressed electrolytically.

9 Claims, 4 Drawing Sheets

APPARATUS AND METHOD FOR ELID GRINDING A LARGE-DIAMETER WORKPIECE TO PRODUCE A MIRROR SURFACE FINISH

BACKGROUND OF THE INVENTION

1. Technical field of the Invention

The present invention relates to an apparatus and method for ELID grinding a large-diameter workpiece such as a silicon wafer to produce a mirror-like finish by using the ELID (electrolytic in-dressing) grinding method.

2. Prior Art

To cut a thin silicon wafer from an ingot of single crystal silicon, conventionally, tools such as (1) an outer-edge cutter, (2) an inner-edge cutter or (3) a wire saw are used.

A typical outer-edge cutter is shown in FIG. 1A; a thin disk-shaped cutting edge 2 with a center shaft 2*a* is rotated at a high speed, and its outer periphery cuts an ingot 1. The inner-edge cutter, shown in FIG. 1B, cuts an ingot 1 using an electrolytically deposited grindstone provided on the inner periphery of a thin disk-shaped cutter 3 with a center hole 3*a* by rotating the cutting disk at a high speed. The wire saw is shown in FIG. 1C, in which an endless fine wire 4 with a diameter of 0.2 to 0.3 mm is moved using a guide pulley 4*a,* while a slurry containing grinding grains is supplied between an ingot 1 and the wire 4, and cuts the ingot 1.

The aforementioned cutting methods require the following conditions to be fulfilled.

(1) Warping of the cut surface (and the entire wafer) must be kept small.

(2) The irregularity of the thickness of a cut wafer, that is TTV (Total Thickness Variation) should be small.

(3) The surface roughness should be small.

Next, the surface of the cut silicon wafer is, as shown generally in FIGS. 2A and 2B, ground by an infeed-type single-surface grinding device that grinds the surface thereof with a cup grindstone 6 while the workpiece 5 (silicon wafer) is rotated about the axis thereof. In addition, a dual-surface grinding device shown in FIG. 2C is also used in practice, in which the driving rollers 7 rotate the workpiece 5 about its own axis, and both surfaces of the workpiece are ground simultaneously.

Recently, silicon ingots have become large in diameter; although conventionally the diameter was limited to about 8 inches (about 200 mm), ingots of 12 inches (about 300 mm) and 16 inches (about 400 mm) can now be manufactured. However, when an ingot with such a large diameter is cut, the results are unavoidably poorer than for a small diameter ingot, in terms of warping of the cut surface, thickness variations and surface roughness.

Therefore, when an attempt is made to cut the surface of a large-diameter ingot as described above using the above-mentioned conventional infeed-type surface grinding equipment, the following problems are encountered.

(1) Because the diameter of the cup grindstone 6 must be larger than the diameter of the workpiece 5, the diameter of the cup grindstone 6 can be as large as, for instance, 500 mm. As a result, the cup grindstone can easily be deflected by the force required to press the cup grindstone onto the workpiece, so the accuracy of processing the surface of the workpiece becomes worse.

(2) Because the cup grindstone 6 must be large, the supporting mechanism and the driving device which rotates it also become large machines weighing as much as several ten of tons, therefore, the equipment is very expensive.

(3) As the cup grindstone becomes large, it takes a very long time to true it, and when electrolytic dressing is applied, large capacity electrolytic equipment is needed (for instance, several thousand amps or more), therefore, the power supply equipment must also be large and costly.

(4) When the workpiece is to be lapped in the next stage of the process after cutting, although it is preferable that the surface of the workpiece should be shaped with a slight recess instead of completely flat, conventional equipment can only cut a workpiece into a flat shape, or even if it can be done in principle, the equipment would become very complicated and the shape of the cut could not be controlled well.

SUMMARY OF THE INVENTION

The present invention is aimed at solving the problems described above. More explicitly, an object of the present invention is to provide an apparatus and method of ELID grinding a large-diameter workpiece to produce a mirror surface finish, that is capable of grinding the surface of a large-diameter wafer without using a large grindstone, that can maintain a high processing accuracy and a small deflection of the grindstone, that can be trued quickly and easily, that can be dressed electrolytically using a small power supply, and that can process the workpiece so that the shape of the cross section is other than a flat plane (for instance, a recessed shape).

According to the present invention, an apparatus is provided for ELID grinding a large-diameter workpiece to produce a mirror surface finish; the apparatus is comprised of a workpiece driving device (12) that makes the workpiece (5) rotate in horizontal, a cylindrical conducting grindstone (14) with an outer periphery that can contact the surface of the workpiece, a grindstone rotating device (16) that causes the aforementioned grindstone to rotate about the axis thereof, a grindstone reciprocating device (18) that drives the above-mentioned grindstone with a reciprocating motion along the line extending from the axis thereof, an axial guiding device (20) that maintain the center line of the axis of the above-mentioned grindstone at a predetermined angle to the horizontal axis, and an ELID device (22) that electrolytically dresses the outer periphery of the grindstone.

In addition, the present invention offers an apparatus for ELID grinding a large-diameter workpiece to a mirror surface finish; the apparatus is comprised of a workpiece driving device (12) that makes the workpiece (5) rotate in horizontal, a cylindrical conducting grindstone (14) with an outer periphery that can contact the surface of the workpiece, a grindstone rotating device (16) that causes the aforementioned grindstone to rotate about the axis thereof, a grindstone reciprocating device (18) that drives the above-mentioned grindstone with a reciprocating motion in a direction orthogonal to the axis of rotation of the workpiece, an axial guiding device (20) that maintains the center line of the axis of the above-mentioned grindstone at a predetermined angle to the horizontal axis, and the ELID device (22) that electrolytically dresses the outer periphery of the grindstone.

Furthermore, the present invention provides a method of ELID grinding a large-diameter workpiece to produce a mirror surface finish, wherein the flat workpiece (5) is driven to rotate in horizontal, the cylindrical conducting grindstone

(14) the outer periphery of which is in contact with the surface of the workpiece and is driven so that it rotates in a horizontal direction about the axis thereof, the aforementioned grindstone is driven with a reciprocating motion along the surface of the workpiece, the center line of the above-mentioned grindstone is maintained at a predetermined angle with respect to the horizontal axis, and at the same time, the outer periphery of the grindstone is dressed electrolytically.

According to the apparatus and the method of the present invention, because the flat workpiece (5) is driven so that it rotates in horizontal by the workpiece driving device (12), and the outer periphery of the cylindrical conducting grindstone (14) the axis of which is substantially horizontal, grinds the surface of the workpiece as the outer periphery contacts the workpiece surface, the diameter of the conducting grindstone can be freely set regardless of the size of the workpiece. Consequently, even when the surface of a wafer with a diameter of, for instance, 16 inches (about 400 mm), is being ground the outer diameter of the grindstone can be made small, so the surface of a large-diameter wafer can be ground without needing a large grindstone.

Moreover, since the diameter of the conducting grindstone can be made small compared to that of the wafer and the bearing of the grindstone rotating device (16) can support the grindstone so that the grindstone can rotate about a substantially horizontal axis, the runout that may occur due to the reaction force of the grinding during the processing of the workpiece can be greatly reduced. In addition, because the ELID device (22) electrolytically dresses the outer periphery of the grindstone, the grinding reaction forces and the associated deflection can be reduced further, thereby the accuracy of processing the surface can be increased.

In addition, as the cylindrical conducting grindstone (14) can be small, both the truing and electrical dressing times are short, so the current needed for electrolytic dressing is small and small and low-cost power supply equipment can be used. Because the axis of the grindstone is kept at a predetermined angle θ to the horizontal by means of the axial guiding device (20) and the grindstone is driven with a reciprocating motion along the axis by the grindstone reciprocating device (18), a wafer can be processed to give cross sections other than a flat surface (for example, a recess) by setting the angle θ appropriately.

According to a preferred embodiment of the present invention, the workpiece driving device (12) is comprised of a plurality of driving rollers (13) that contact the outer periphery of the flat workpiece (5) and cause the workpiece to rotate; whereby a pair of upper and lower conducting grindstones (14) can contact the upper and lower surfaces of the workpiece, respectively.

Using this configuration, a plurality of driving rollers (13) drive the flat workpiece (5) so that it rotates, and a pair of upper and lower conducting grindstones (14) grind both surfaces of the workpiece at the same vertical position at the same time, and even if there are variations in thickness or warping of the workpiece, the workpiece can be ground and processed to a predetermined shape (flat, convex or concave).

The aforementioned conducting grindstone (14) is a metal-bonded grindstone. The ELID device (22) is provided with an ELID electrode (23) positioned close to but separate from the outer periphery of the grindstone, a voltage applying means (24) that applies DC voltage pulses between the grindstone as the positive electrode and the electrode as the negative electrode, and a processing fluid feeding means (25) that feeds a conducting processing fluid between the grindstone and the electrode; the workpiece is ground by the grindstone and, at the same time the outer periphery of the grindstone is dressed electrolytically.

In this configuration, since the surface of the metal-bonded grindstone can be sharpened precisely by electrolytic dressing, a cut surface can be finished to an excellent, flat surface very close to a mirror surface finish by using microscopic grinding grains. In addition, the load on the next process (polishing) can be greatly reduced, and processing damage to the crystals can be minimized.

Other objects and advantages of the present invention are revealed in the following paragraphs referring to the attached drawings.

DESCRIPTION OF PREFERRED EMBODIMENTS

Figure 1A:
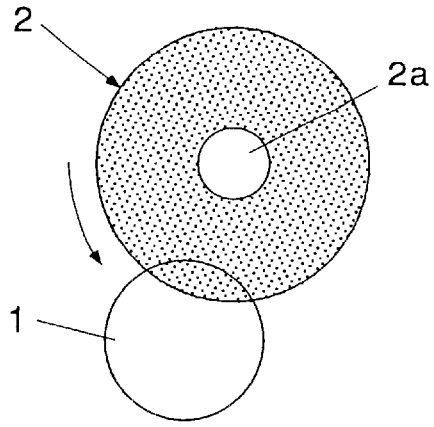
Fig.1A (Prior Art)
FIGS. 1A to 1C are illustrations showing conventional cutting devices.
Figure 1B:
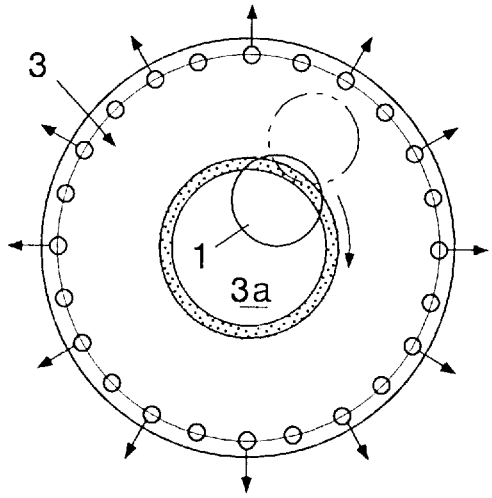
Fig.1B (Prior Art)
Figure 1C:
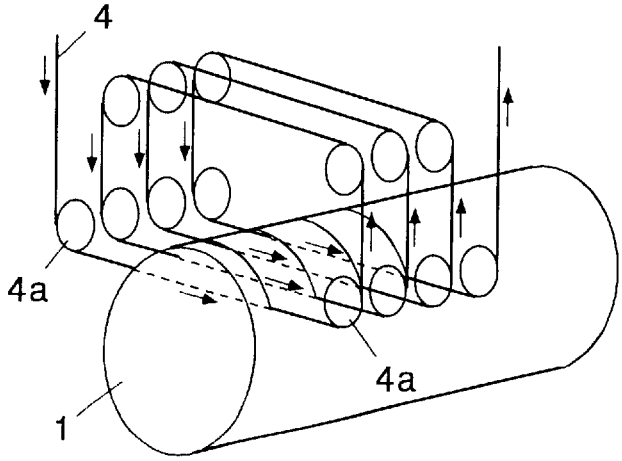
Fig.1C (Prior Art)
Figure 2A:
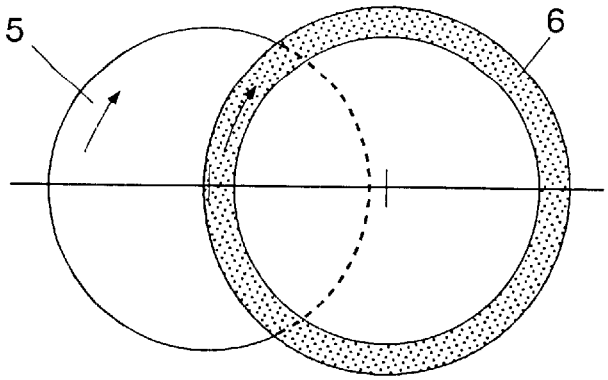
Fig.2A (Prior Art)
FIGS. 2A to 2C show conventional grinding devices.
Figure 2B:
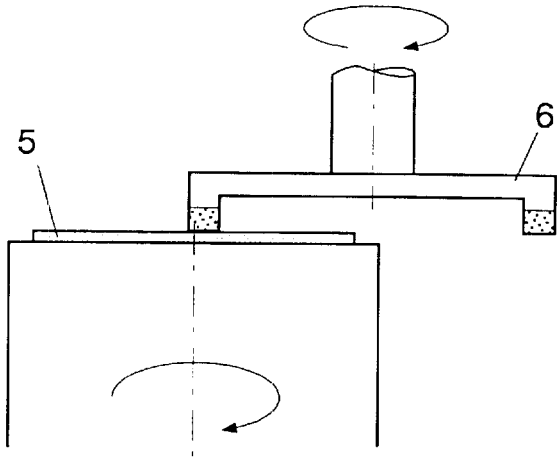
Fig.2B (Prior Art)
Figure 2C:
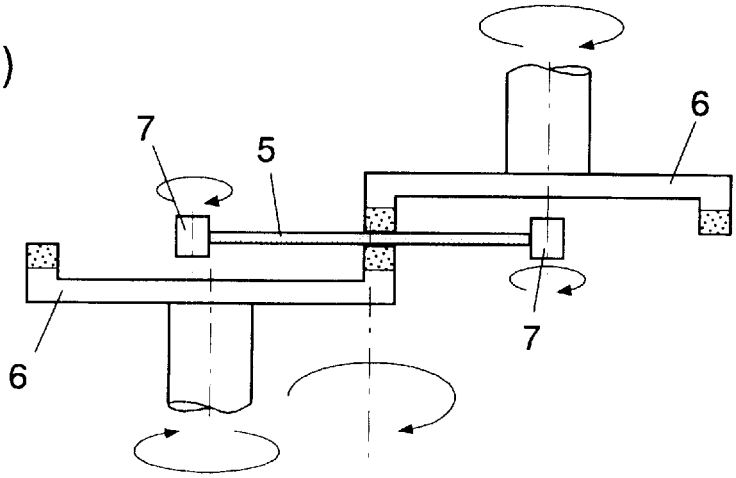
Fig.2C (Prior Art)

Preferred embodiments of the present invention are described below referring to the drawings. In each drawing, identical portions are identified with the same reference numbers, and duplicate explanations are omitted.

Figure 3:
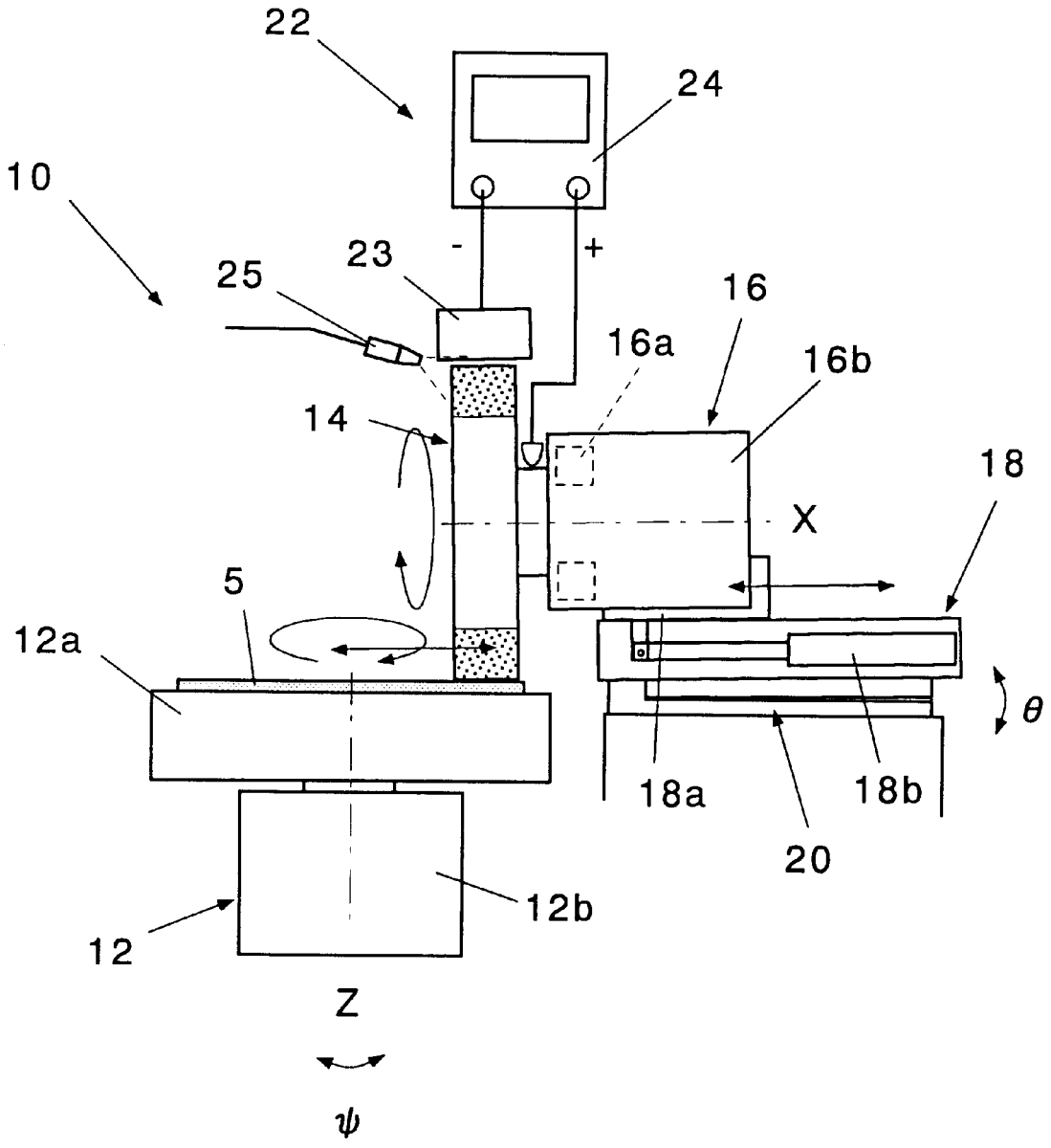
FIG. 3 is a view showing a configuration of the first embodiment of the ELID grinding apparatus according to the present invention.

FIG. 3 is a view showing a configuration of the first embodiment of the ELID grinding apparatus according to the present invention. An ELID grinding apparatus 10 according to the present invention is comprised of a workpiece driving device 12, a conducting grindstone 14, a grindstone rotating device 16, a grindstone reciprocating device 18, an axial guiding device 20 and an ELID device 22.

The flat workpiece 5, in this example, is a single-crystal silicon wafer with an outer diameter of about 16 inches (about 400 mm). However, the present invention is not limited only to this type of wafer, but is also applicable to other wafers, such as SiC wafers and quartz wafers. Of course, the present invention can also be applied to the processing of thick workpieces, therefore, applications of the present invention are not limited only to wafers.

The workpiece driving device 12 is comprised of, in this example, a mounting base 12*a* with a horizontal upper surface and a driving device 12*b* that rotates the base about an axis Z of rotation vertical thereto, and rotates the workpiece 5 that is fixed to the upper surface of the mounting base 12*a*, in horizontal. The axis Z of rotation of the driving device 12*b* is preferably disposed so that it can tilt and contact is made at an angle ψ to the vertical axis.

The conducting grindstone 14 is a cylindrical metal-bonded grindstone with an outer surface that contacts the surface of the workpiece. This metal-bonded grindstone is made from grinding grains (for example, diamond grinding grains) and a metal-bonding material. In addition, plastic powder can also be mixed in the material. The particle size of the grinding grains should be as small as possible so as to finish the surface of the workpiece excellently to nearly a mirror surface finish with a high degree of flatness; for instance, the grain diameter can be 2 μm (equivalent to particle size #8000) to 5 nm (particle size #3,000,000). To increase the cutting efficiency, relatively coarse grains, for example, particle size #325 up to 4 μm (equivalent to particle size #4000) can also be used. Using coarse grinding grains, the surface of a workpiece can be processed efficiently, and using fine grinding grains, the surface of the workpiece can be finished to give an excellent flat surface with a finish very close to a mirror surface finish.

The grindstone rotating device 16 is comprised of a bearing 16*a* for supporting the grindstone 14 so that it is free to rotate about the axis X thereof and a driving device 16*a* for rotating the grindstone 14 about the center line X thereof. In addition, the grindstone reciprocating device 18 is comprised of a guide 18*a* that guides the grindstone rotating device 16 which rotates the grindstone so that it move with a reciprocating motion along the axis X thereof and a driving cylinder 18*b* to move the grindstone rotating device 16 along the guide with a reciprocating motion.

The axial guiding device 20 holds the device 18 which moves the grindstone at a predetermined angle θ to the horizontal plane, and keeps the center line X of the grindstone 14 at this angle to the horizontal axis. The angle θ can be selected freely, that is, either 0° or a positive or negative angle. The angle can also be varied intermittently using a numerical control system such as a swinging device. In such a case, it becomes possible to create a spherical shape with predetermined radius of curvature or with a variable radius of curvature, for instance, an aspherical shape.

The ELID device 22, shown in FIG. 3, is provided with an ELID electrode 23, close to but separated from the outer periphery of the grindstone 14, a voltage applying means 24 that applies DC voltage pulses between the grindstone 14 as the positive electrode and the electrode 23 as the negative electrode, and a processing fluid feeding means 25 which feeds a conducting processing fluid between the grindstone 14 and the electrode 23.

According to this configuration, the outer periphery of the grindstone can be dressed electrolytically, and the workpiece 5 is being ground by the grindstone 14 simultaneously.

According to the method of the present invention using the aforementioned ELID grinding apparatus 10 in the configuration shown in FIG. 3, the flat workpiece 5 is driven so that it rotates in horizontal by the workpiece driving device 12 so that it rotates in horizontal, the cylindrical conducting grindstone 14, the outer periphery of which is in contact with the surface of the workpiece, is driven so that it rotates about the axis X thereof by the grindstone rotating device 16, the grindstone 14 is driven along the center line X thereof with a reciprocating motion by means of the grindstone reciprocating device 18, the axis X of the grindstone 14 is held at a predetermined angle θ to the horizontal axis by the axial guiding device 20, and at the same time, the outer periphery of the grindstone 14 is dressed electrolytically by the ELID device 22.

According to the aforementioned apparatus and method of the present invention, the flat workpiece 5 is driven so as to rotate in horizontal, and the outer periphery of the cylindrical conducting grindstone 14, the axis of which is substantially horizontal contacts and grinds the surface of the workpiece, therefore, the diameter of the conducting grindstone can be set freely regardless of how large the workpiece is. Consequently, even when the surface of a wafer with a diameter of 16 inches (about 400 mm) is to be ground, the outer diameter of the grindstone can be made small, and the surface of a large-diameter wafer can be ground, without using a large diameter grindstone.

Since the diameter of the conducting grindstone can be made smaller than that of the wafer and the grindstone 14 can be held so that it can rotate about the essentially horizontal axis X by means of the bearing 16*a* of the grindstone rotating device 16, the runout of the workpiece, due to the reaction force of grinding during processing, can be greatly reduced. Also because the outer periphery of the grindstone 14 is dressed electrolytically by the ELID device 22, the grinding reaction force and the deflection caused thereby can be further reduced, so the accuracy of processing the surface can be increased.

Since the conducting grindstone 14 is made small, the truing time thereof is shorter, the electric current needed for electrolytic dressing becomes small, and the power supply can be made small and cheap. As the axis of the grindstone is held at a predetermined angle θ to the horizontal axis by the axial guiding device 20 and the grindstone 14 is moved along the axis X thereof with a reciprocating motion by the grindstone reciprocating device 18, the wafer can also be processed to produce a cross section with a shape other than a plane (for instance, a concavity) by appropriately setting the angle θ.

Figure 4:
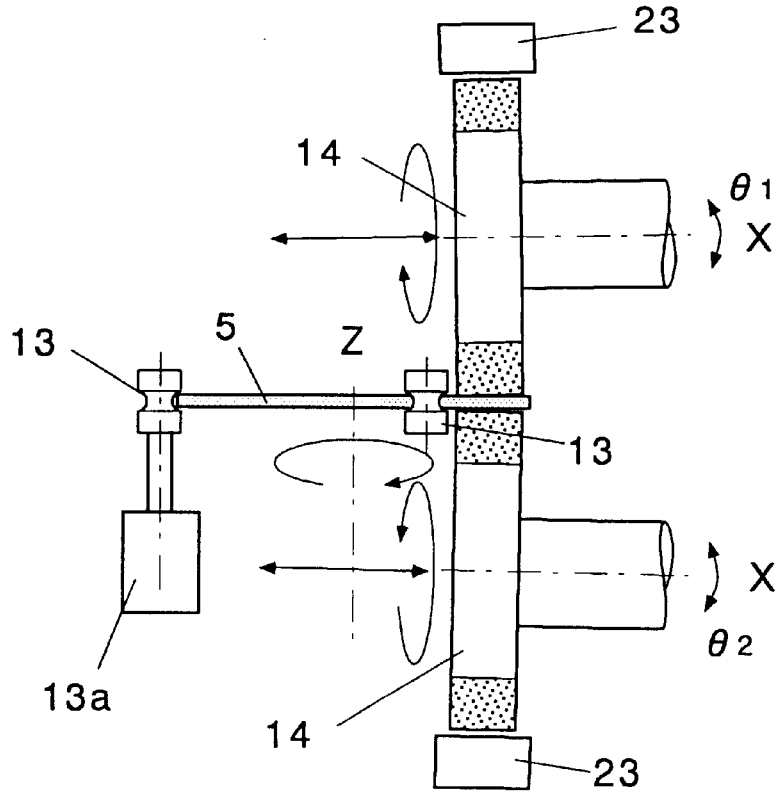
FIG. 4 is a view showing a configuration of the second embodiment of the ELID grinding apparatus according to the present invention.

FIG. 4 shows the second embodiment of the ELID grinding apparatus according to the present invention. In FIG. 4, the workpiece driving device 12 which rotates the workpiece is comprised of a plurality of (at least three) driving rollers 13 that contact the outer periphery of the flat workpiece 5 and rotate the workpiece. These driving rollers 13 are made to rotate by the driving device 13*a,* while the rollers are individually pressed against the outer periphery of the workpiece 5 with predetermined forces, thus the device rotates the workpiece 5 about the axis Z. In this example, although the center portion of a driving roller 13 is recessed to grip the outer periphery of the workpiece 5, separate supporting rollers can also be provided to hold the workpiece.

In this example, a pair of upper and lower conducting grindstones 14 are provided; the grindstones 14 are disposed so that they contact both sides of the workpiece 5 directly opposite each other. The other details of the configuration are the same as those shown in FIG. 3. In this case, it is preferred to provide the aforementioned grindstone rotating device 16, grindstone reciprocating device 18, axial guiding device 20 and ELID device 22 separately for each grindstone, these devices can also be combined into a single unit, if required, in order to share the operations.

The configuration shown in FIG. 4 provides the same functions as those of the configuration shown in FIG. 3. Using the configuration shown in FIG. 4, particularly with a plurality of driving rollers 13, both sides of the workpiece can be ground simultaneously at points directly opposite each other using a pair of upper and lower conducting grindstones 14 while the flat workpiece 5 is rotated, so even if there is warping or variations in the thickness of the workpiece, the workpiece can be ground and processed into a preferred shape (flat, convex or concave). Also, by changing the angles of the upper and lower grindstones, it is possible to process the upper and lower surfaces to produce concave and convex shapes, respectively.

Figure 5:
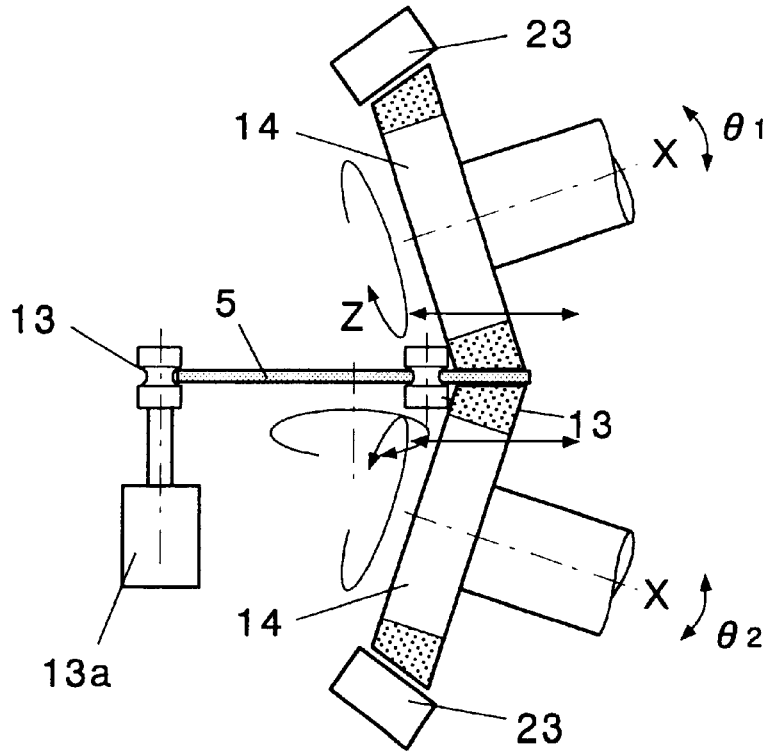
FIG. 5 is a view showing a configuration of the third embodiment of the ELID grinding apparatus according to the present invention.

FIG. 5 shows the configuration of the third embodiment of the ELID grinding apparatus according to the present invention. In FIG. 5, a pair of upper and lower conducting grindstones 14 are shaped as parts of a cone, and the conical surfaces thereof contact both sides of the workpiece. In this example, the above-mentioned grindstone reciprocating device 18 gives a reciprocating motion to the grindstone rotating device 16 on each surface of the workpiece (that is, in the direction orthogonal to the axis Z of rotation). The other details of the configuration are the same as those of the second embodiment. Using this configuration, interference between the rollers and the grindstones can be easily avoided.

Thus, the method and apparatus for ELID grinding a large-diameter workpiece according to the present invention offer various preferred advantages such as that the surface of a large-diameter wafer can be ground without using a large grindstone, that the grindstone is deflected by only a very small amount and a high processing accuracy can be maintained, that the grindstone can be trued quickly and easily, that the grindstone can be dressed electrolytically using a small power supply, and that the workpiece can also be processed into a cross sectional shape other than a flat plane (for example, a convex shape).

However, the present invention should not be limited only to the above-mentioned embodiments and examples, and of course can be modified in various ways as long as the scope of claims of the present invention is not exceeded.

What is claimed is:

1. An apparatus for ELID grinding a large-diameter workpiece to produce a mirror surface finish, comprising:

(a) a workpiece driving device that rotates a flat workpiece so as to rotate in horizontal;

(b) a first cylindrical conducting grindstone having an outer periphery in contact with a surface of the workpiece;

(c) a grindstone rotating device that drives the grindstone to rotate about a first axis thereof;

(d) a grindstone reciprocating device that moves the grindstone with a reciprocating motion along the first axis thereof;

(e) an axial guiding device that keeps a center line on the first axis of the grindstone at a predetermined angle to a horizontal axis; and (f) an ELID device that electrolytically dresses the outer periphery of the grindstone.

2. An apparatus for ELID grinding a large-diameter workpiece to produce a mirror surface finish, comprising:

(a) a workpiece driving device that rotates a flat workpiece so as to rotate in horizontal;

(b) a first cylindrical conducting grindstone having an outer periphery in contact with a surface of the workpiece;

(c) a grindstone rotating device that drives the grindstone to rotate about a first axis thereof;

(d) a grindstone reciprocating device that moves the grindstone with a reciprocating motion in a direction orthogonal to the axis of rotation of the workpiece;

(e) an axial guiding device that keeps a center line on the first axis of the grindstone at a predetermined angle to the horizontal axis; and (f) an ELID device that electrolytically dresses the outer periphery of the grindstone.

3. The apparatus specified in claim 1, wherein the workpiece driving device comprises a plurality of driving rollers that contact the outer periphery of the flat workpiece and rotate the workpiece, and the first conducting grindstone is disposed to contact an upper side of the workpiece, and the apparatus further comprises: a second conducting grindstone disposed so as to contact a lower side of the workpiece.

4. The apparatus specified in claim 1, wherein the conducting grindstone comprises a metal-bonded grindstone, the ELID device comprises an ELID electrode that is close to but separate from the outer periphery of the grindstone, and the apparatus further comprises:

(g) a voltage applying means that applies DC voltage pulses between the grindstone, which is a positive electrode, and a negative electrode; and (h) a processing fluid feeding means that feeds a conducting processing fluid between the grindstone and the electrode, in which, while the grindstone grinds the workpiece, the outer periphery of the grindstone is simultaneously dressed electrolytically.

5. A method for ELID grinding a large-diameter workpiece to produce a mirror surface finish, the method comprising the steps of:

driving a flat workpiece to rotate in horizontal;

providing a cylindrical conducting grindstone having an outer periphery in contact with a surface of the workpiece and driving the grindstone to rotate about a first axis thereof;

moving the grindstone along the surface of the workpiece with a reciprocating motion while keeping a center line on the first axis of the grindstone at a predetermined angle to a horizontal axis of the grindstone; and at the same time as moving the grindstone, the outer periphery of the grindstone is dressed electrolytically.

6. The apparatus specified in claim 2, wherein the workpiece driving device comprises a plurality of driving rollers that contact an outer periphery of the flat workpiece and rotate the workpiece, and the first conducting grindstone is disposed to contact an upper side of the workpiece, and the apparatus further comprises: a second conducting grindstone disposed so as to contact a lower side of the workpiece.

7. The apparatus specified in claim 2, wherein the conducting grindstone comprises a metal-bonded grindstone, the ELID device comprises an ELID electrode (23) that is close to but separate from the outer periphery of the grindstone, and the apparatus further comprises:

(g) a voltage applying means that applies DC voltage pulses between the grindstone, which is a positive electrode, and a negative electrode; and (h) a processing fluid feeding means that feeds a conducting processing fluid between the grindstone and the electrode, in which, while the grindstone grinds the workpiece, the outer periphery of the grindstone is simultaneously dressed electrolytically.

8. The apparatus specified in claim 3, wherein the first and the second conducting grindstones each comprise a metal-bonded grindstone, the ELID device comprises an ELID electrode that is close to but separate from the outer periphery of the grindstone, and the apparatus further comprises:

(g) a voltage applying means that applies DC voltage pulses between the grindstone, which is a positive electrode, and a negative electrode; and (h) a processing fluid feeding means that feeds a conducting processing fluid between the grindstone and the electrode, in which, while each grindstone grinds the workpiece, the outer periphery of the grindstone is simultaneously dressed electrolytically.

9. The apparatus specified in claim 6, wherein the first and the second conducting grindstones each comprise a metal-bonded grindstone, the ELID device comprises an ELID electrode that is close to but separate from the outer periphery of the grindstone, and the apparatus further comprises:

(g) a voltage applying means that applies DC voltage pulses between the grindstone, which is a positive electrode, and a negative electrode; and (h) a processing fluid feeding means that feeds a conducting processing fluid between the grindstone and the electrode, in which, while each grindstone grinds the workpiece, the outer periphery of the grindstone is simultaneously dressed electrolytically.

* * * * *